US005894244A

United States Patent [19]

Ukita

[11] Patent Number: 5,894,244

[45] Date of Patent: Apr. 13, 1999

[54] SEMICONDUCTOR POTENTIAL SUPPLY DEVICE AND SEMICONDUCTOR MEMORY APPARATUS USING THE SAME

[75] Inventor: Motomu Ukita, Tokyo, Japan

[73] Assignee: Mitsubishi Denki Kabushiki Kaisha, Tokyo, Japan

[21] Appl. No.: 08/672,169

[22] Filed: Jun. 27, 1996

[30] Foreign Application Priority Data

Nov. 16, 1995 [JP] Japan ..... 7-298252

[51] Int. Cl.[6] ..... G05F 3/20

[52] U.S. Cl. ..... 327/541; 327/525

[58] Field of Search ..... 327/525, 538, 327/540, 541, 543; 323/313

[56] References Cited

U.S. PATENT DOCUMENTS

| | | | |
|---|---|---|---|
| 4,833,342 | 5/1989 | Kiryu et al. | 327/541 |
| 5,258,947 | 11/1993 | Sourgen | 365/96 |
| 5,424,655 | 6/1995 | Chua | 327/525 |
| 5,729,155 | 3/1998 | Kobatake | 326/68 |

FOREIGN PATENT DOCUMENTS

| | | |
|---|---|---|
| 3-207091 | 9/1991 | Japan . |
| 5-290572 | 11/1993 | Japan . |

*Primary Examiner*—David Nelms

*Assistant Examiner*—M Tran

*Attorney, Agent, or Firm*—McDermott, Will & Emery

[57] ABSTRACT

A resistor connected in series with a source of external supply potential and a transistor circuit. The transistor circuit comprises a plurality of MOS transistors each of whose drain and gate are connected together, and is grounded. This transistor circuit detects whether an external supply potential is below or above a specific value. When the external supply potential is detected as being below the specific value, another MOS transistor connected to the source of external supply potential is made to conduct, and the external supply potential is supplied to a semiconductor memory circuit without voltage step-down. However, when the external supply potential is detected as being above the specific value, the external supply potential is stepped down through the other MOS transistor, and supplied to the semiconductor memory circuit. An internal supply potential is supplied to a semiconductor memory circuit device in a specific range even if the external supply potential fluctuates.

14 Claims, 14 Drawing Sheets

SEMICONDUCTOR POTENTIAL SUPPLY DEVICE AND SEMICONDUCTOR MEMORY APPARATUS USING THE SAME

TECHNICAL FIELD

The present invention relates to a semiconductor potential supply device for supplying a potential within a specific range to a semiconductor memory apparatus, and to a semiconductor memory apparatus using the same. In particular the invention is preferably employed in a semiconductor memory apparatus of a low power consumption type.

BACKGROUND ART

First, an example of a conventional semiconductor potential supply device used in a semiconductor memory apparatus is hereinafter described.

FIG. 14 shows a semiconductor potential supply device (a step-down circuit) used for supplying a potential within a specific range to a conventional static random access memory device (SRAM) (see Japanese Laid-open Patent Publication, unexamined, Hei. 3207091). FIG. 15 is a diagram showing a relation between an external supply voltage and an internal supply voltage determined by this step-down circuit.

In FIG. 14, the step-down circuit includes an external power line VCC (potential VCC), a ground VG, resistors R1, R2, R3, P-channel MOS transistors Q1, Q2, an N-channel MOS transistor Q3, nodes N1, N2, N3, and an internal circuit C that is a semiconductor memory circuit such as a SRAM.

Operation of this conventional step-down circuit is described below. When the external supply voltage is low, for example, 3 V, the P-channel MOS transistor Q1 is turned off by the voltage of the node N1 determined by the ratio of resistors R1 and R2, and the node N2 is lowered nearly to 0 V by the resistor R3. As a result, the P-channel MOS transistor Q2 is turned on, and the voltage VINT of the node N3 supplied to the internal circuit C becomes 3 V that is the same as the external voltage VCC.

On the other hand, when the external voltage VCC becomes higher than a prescribed value for activity, or "action point", for example 5 V, the P-channel MOS transistor Q1 is turned on by the node N1, and the node N2 is raised nearly to the supply voltage VCC, and the P-channel MOS transistor Q2 is turned off. As a result, current through the N-channel MOS transistor Q3 is supplied to the internal circuit C, and its internal supply voltage VINT is lowered from 5 V of the external supply voltage VCC by a portion of the threshold voltage Vtn', i.e., about 1.5 V of the transistor Q3 having back gate effect, and drops to about 3.5 V.

In this way, reliability is secured for preventing high voltage from being applied to the internal circuit C, and at the same, even when the external voltage VCC is lowered, data of memory cells in the internal circuit C is not lost. The prescribed value (action point) to change whether the potential supplied to the internal circuit C is directly coupled to the external potential VCC or internally lowered in the step-down circuit is determined substantially by the ratio of the resistors R1 and R2.

FIG. 16 shows a relation between a potential at node N1 and an external voltage VCC in the conventional step-down circuit. Supposing that the external voltage is VCC, a potential at the node N1 is VN1, and a threshold voltage without back gate effect of the P-channel MOS transistor Q1 is Vtp, the P-channel MOS transistor Q1 is turned on when the following relation is established.

$$VCC-VN1=Vtp$$

And a step-down state and a direct coupling state are changed over. The VCC at this moment is called an action point Vsp. At this time, following expressions are obtained.

$$Vsp-VN1=Vtp$$

$$Vsp=VN1+Vtp$$

In the conventional step-down circuit, however, the potential of the node N1 is determined by the ratio of resistors R1:R2. If this ratio deviates or fluctuates due to variation of manufacturing process or the like, the prescribed action point value may be shifted out of the intended voltage.

In FIG. 16, line "b" represents magnitude of external supply voltage, and line "c" shows a potential at node N1 at a specific resistor ratio R1:R2. Therefore, when VCC–VN1 is Vtp, the desired action point value VSP is achieved. However, when the resistor ratio R1:R2 is varied, the potential of the node N1 becomes as indicated by line "d" for example, and the prescribed value becomes varied.

In this manner, in the conventional step-down circuit, there arises the above-discussed problem and, moreover, the following problem takes place. First of all, particularly in a SRAM of low power consumption, the resistors used in the step-down circuit are as high as a several hundred megohm level in order to decrease the current consumed in the step-down circuit itself. These resistors are composed of very thin films in order to have a large resistor value. And since the films are thin, the resistor value thereof fluctuates significantly depending on formation of crystal, azimuth or bearing, etc. Therefore, a problem exists in that even if the voltage is subject to resistor division, for example, divided into 1:4, it may not actually be always 1:4.

Moreover, since the resistor value is very large as mentioned above, current is very small, and when the supply voltage is 5 V, for example, current is about 50 nA (5×10-8 A) at most. Therefore, the node N1 whose potential is determined by the resistor division requires a very long time until a desired potential is established. Hence, being unable to track sudden changes of external voltage VCC, the step-down circuit may supply an unintended voltage until the potential of the node N1 is sufficiently established.

DISCLOSURE OF THE INVENTION

The present invention was made to solve the above-discussed problems, and has an object of providing a semiconductor potential supply device capable of supplying a potential controlled within a certain range, even if an external supply voltage fluctuates, by causing voltage step-down at a prescribed voltage value of action point potential. The semiconductor potential supply device of this invention supplies a potential to a semiconductor memory circuit for example, and the present invention also provides a semiconductor memory apparatus using the same.

It is a primary object of the invention to provide a semiconductor potential supply device which comprises a constant voltage circuit means, an input circuit means and an output circuit means.

The constant voltage circuit means includes a resistor and a constant voltage transistor circuit connected in series at a first node, the resistor is connected to a first power source line, and the constant voltage transistor circuit is connected to a second power source line.

The input circuit means includes a first transistor circuit and a resistor connected in series at a second node. The first transistor circuit is connected to the first power source line, a control electrode of the first transistor circuit is supplied with a potential from the first node, and the resistor is connected to the second power source line.

The output circuit means includes a second transistor circuit and a third transistor circuit. The second transistor circuit is connected between the first power source line and a third node for supplying a potential, a control electrode of the second transistor circuit is supplied with a potential from the second node, and the third transistor circuit is connected parallel to the second transistor circuit.

In an aspect of the invention, the first power source line may be a power source line and the second power source line may be a grounded line. In another aspect of the invention, the first power source line may be a grounded line and the second power source line may be a power source line.

Another object of the invention is to provide a semiconductor potential supply device as stated above, wherein the constant voltage transistor circuit is comprised of one or a plurality of MOS transistors connected in series with their gate and drain connected together.

Another object of the invention is to provide a semiconductor potential supply device as stated above, wherein the constant voltage transistor circuit is comprised of one or a plurality of P-channel MOS transistors and of N-channel MOS transistors connected in series with their gate and drain connected together.

Another object of the invention is to provide a semiconductor potential supply device as stated above, wherein the constant voltage transistor circuit is comprised of at least one MOS transistor free from back gate effect.

Another object of the invention is to provide a semiconductor potential supply device as stated above, wherein at least one of the MOS transistors comprised in the constant voltage transistor circuit is short-circuited by a fuse.

Another object of the invention is to provide a semiconductor potential supply device as stated above, wherein at least one of the MOS transistors free from back gate effect is short-circuited by a fuse in the constant voltage transistor circuit.

Another object of the invention is to provide a semiconductor potential supply device as stated above, wherein the third transistor circuit is comprised of a MOS transistor having gate and drain connected together.

A further object of the invention is to provide a semiconductor memory device which comprises a constant voltage circuit means, an input circuit means, an output circuit means and a semiconductor memory circuit.

The constant voltage circuit means includes a resistor and a constant voltage transistor circuit connected in series at a first node, the resistor is connected to a first power source line, and the constant voltage transistor circuit is connected to a second power source line.

The input circuit means includes a first transistor circuit and a resistor connected in series at a second node, the first transistor circuit is connected to the first power source line, a control electrode of the first transistor circuit is supplied with a potential from the first node, and the resistor is connected to the second power line.

The output circuit means includes a second transistor circuit and a third transistor circuit, the second transistor circuit is connected between the first power source line and a third node for supplying a potential, a control electrode of said second transistor circuit is supplied with a potential from said second node, and said third transistor circuit is connected in parallel to said second transistor circuit; and a semiconductor memory circuit is connected to said third node and supplied with a potential from said third node.

Other features and advantages of this invention will become more apparent from the following descriptions.

BEST MODE FOR CARRYING OUT THE INVENTION

This invention will be described in further detail by way of example with reference to the accompanying drawings.

First Embodiment

Figure 1:
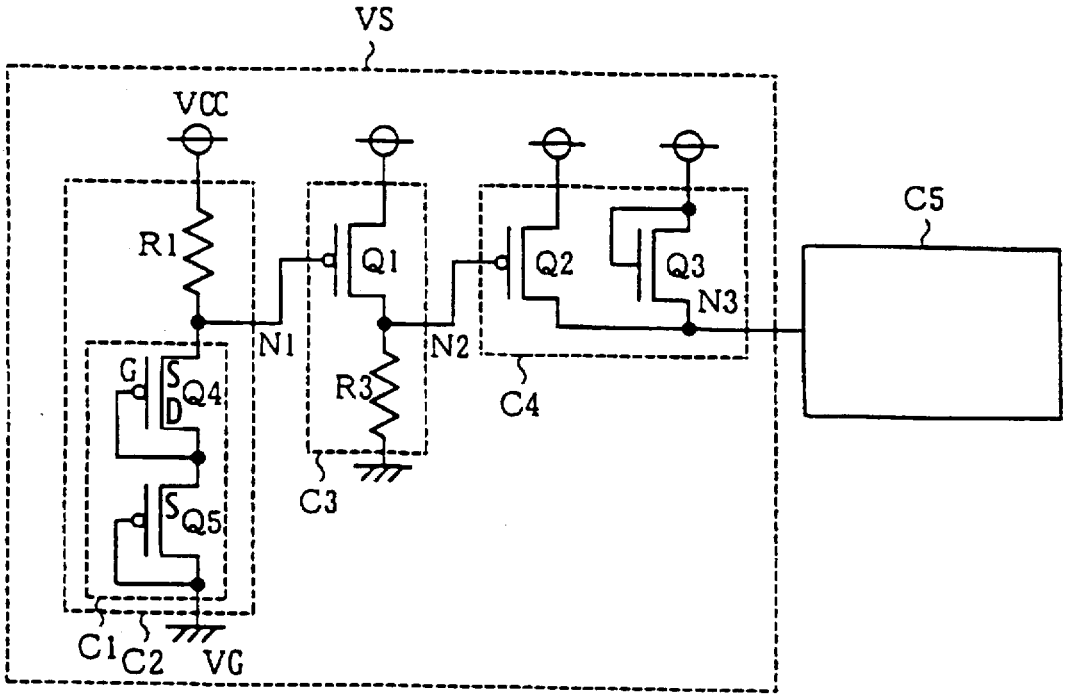
FIG. 1 s a circuit diagram of a first embodiment for carrying out the present invention showing a semiconductor potential supply device and a semiconductor memory device using the same.

FIG. 1 is a circuit diagram showing a first embodiment of the present invention for a semiconductor potential supply device and semiconductor memory device using the same. In the diagram, the semiconductor potential supply device (hereinafter called a step-down circuit) VS comprises a first power source line VCC; a second power source line VG; resistors R1, R3; a constant voltage transistor circuit C1; a constant voltage circuit means C2; an input circuit means C3; an output circuit means C4; a semiconductor memory circuit CS (hereinafter called an internal circuit); a P-channel type MOS field effect transistor (FET) Q1 as a first transistor circuit; a P-channel type MOS field effect transistor (FET) Q2 as a second transistor circuit; an N-channel type field effect transistor (FET) Q3 as a third transistor circuit; P-channel type MOS field effect transistors (FET) Q4, Q5; a first node N1; a second node N2; and a third node N3. In each transistor, S, D, G respectively indicate a source, drain and gate.

In this first embodiment, resistor R1 and the constant voltage transistor circuit C1 are connected in series at the first node N1 in the constant voltage circuit means C2. Resistor R1 is connected to the supply potential line VCC as a first power source line and the constant voltage transistor circuit C1 is connected to ground potential line VG as a second power source line. This constant voltage transistor circuit C1 is comprised of a plurality of MOS transistors Q4, Q5 of P-channel type with each gate and drain connected thereto.

In the input circuit means C3, the first MOS transistor Q1 of P-channel type is connected to the supply potential line VCC and a potential from the first node N1 is supplied to its gate G serving as a control electrode. The first MOS transistor Q1 and the resistor R3 connected to the ground potential line VG are connected in series at the second node N2.

The output circuit means C4 includes the second MOS transistor Q2 of P-channel type which is connected between the supply potential line VCC and the third node N3 for supplying a potential to the internal circuit 5, and the potential from the second node N2 is supplied to the gate G serving as a control electrode. The third MOS transistor Q3 of N-channel type is connected in parallel to this second MOS transistor Q2.

Figure 2:
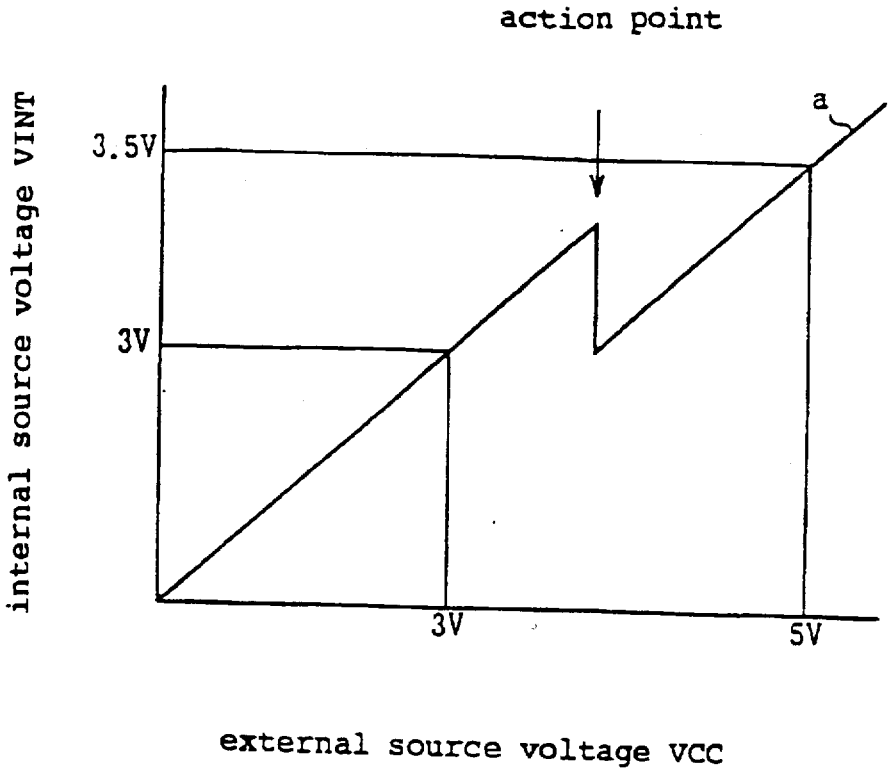
FIG. 2 is a diagram for explaining the operation of a first embodiment for carrying out the invention.

Operation of the semiconductor potential supply device according to this first embodiment is described below. FIG. 2 shows a relation between the external supply voltage (hereinafter called external voltage) VCC and the internal supply voltage (hereinafter called internal voltage) VINT given to the internal circuit C5 through the step-down circuit VS. As in the prior art, when the external voltage VCC is low, the external voltage is not stepped down but is directly supplied to the internal circuit C5. When the external voltage VCC is high, the external voltage is stepped down and supplied. For example, as shown in FIG. 2, when the external voltage VCC is 3 V, the internal voltage VINT is also 3 V, and when the external voltage VCC is 5 V, the internal voltage VA is 3.5 V. As a result, even when the external voltage is high, the reliability of the transistor of the internal circuit C5 is guaranteed. When the external voltage is low, the voltage is not stepped down, so that the data stored in the memory cell is not disturbed.

Figure 3:
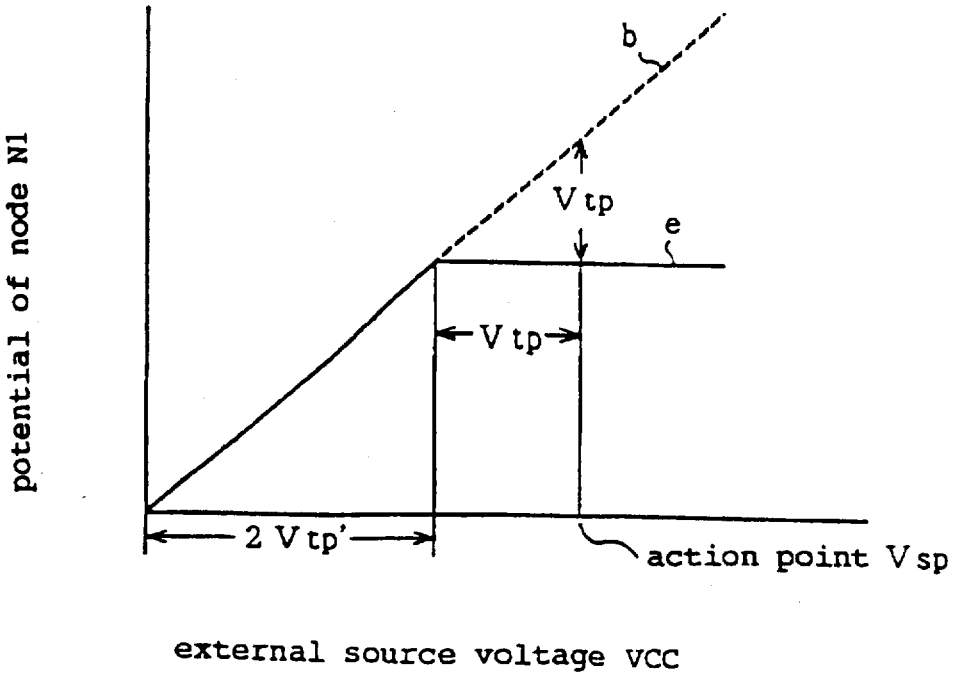
FIG. 3 is a diagram for explaining the operation of a first embodiment for carrying out the invention.

FIG. 3 shows a relation between the potential at the node N1 and the external voltage VCC in the step-down circuit VS in the first embodiment. In the diagram, line "b" denotes the magnitude of external voltage VCC, and polygonal line "e" indicates the potential at node N1. Suppose that the external voltage is VCC, the potential at node N1 is VN1, and the threshold voltage without back gate effect of P-channel MOS transistor Q1 is Vtp. When the following relation is established $$VCC-VN1=Vtp,$$

the P-channel MOS transistor Q1 is turned on. The step-down of the external voltage VCC and the direct coupling from the external voltage VCC are reversed. When the VCC at this moment is at a prescribed value VSP for activity (action point), there is established the following relation:

$$VSP-VN1=Vtp$$

$$VSP=VN1+Vtp$$

In the conventional step-down circuit, the potential at the node N1 differed from the intended voltage as the action point due to fluctuations of the ratio of resistors R1:R2. On the other hand, in the first embodiment of the invention, even if the resistor should fluctuate, the node N1 is determined by the sum of the threshold voltages of the transistors Q4 and Q5. That is, if Vtp' is a threshold with back gate effect of the P-channel MOS transistor, the prescribed action point value is attained just when the external supply voltage VCC becomes 2 Vtp'+Vtp.

When the supply voltage VCC is 2 Vtp'+Vtp or less, transistors Q4 and Q5 are OFF, and the node N1 is charged by the resistor R1 at potential VCC. As a result, the P-channel MOS transistor Q1 is turned off, the P-channel MOS transistor Q2 is turned on, and the external voltage VCC is directly coupled to internal circuit C5.

On the other hand, when the external voltage VCC is larger than 2 Vtp'+Vtp, the P-channel MOS transistors Q4 and Q5 are turned on, and the node N1 is fixed at 2 Vtp'. Consequently, the P-channel MOS transistor Q1 is turned on to charge the node N2, and the P-channel MOS transistor Q2 is turned off. As a result, current supplied to the internal semiconductor memory circuit unit C5 passes only through the N-channel MOS transistor Q3, and the potential stepped down by a portion of the threshold voltage Vtn of the N-channel MOS transistor Q3 is supplied to the internal circuit C5.

In this first embodiment, the action point is always specified by 2 Vtp'+Vtp, and therefore, even if the resistor value R1 fluctuates, the prescribed voltage value does not change significantly. Usually Vtp=0.7 V and Vtp'=1.4 V approximately, and the prescribed voltage value is around 3.5 V. That is, in normal operation with an external power source at 5 V, a step down takes place by the step-down circuit VS, and in case of data holding only, stepping down is not performed, and the data of the memory cell in the internal circuit C5 is protected.

When the external voltage VCC rises suddenly, for example, when changed from a data holding mode at 3 V to a normal 5 V, in the conventional device, it takes a very long time until the potential of the node N1 drops. On the other hand, in the first embodiment, by establishing the potential of the node N1 instantaneously after the P-channel MOS transistors Q4 and Q5 are turned on, the internal voltage is changed over by tracking the changes of the external power source VCC.

Second Embodiment

Figure 4:
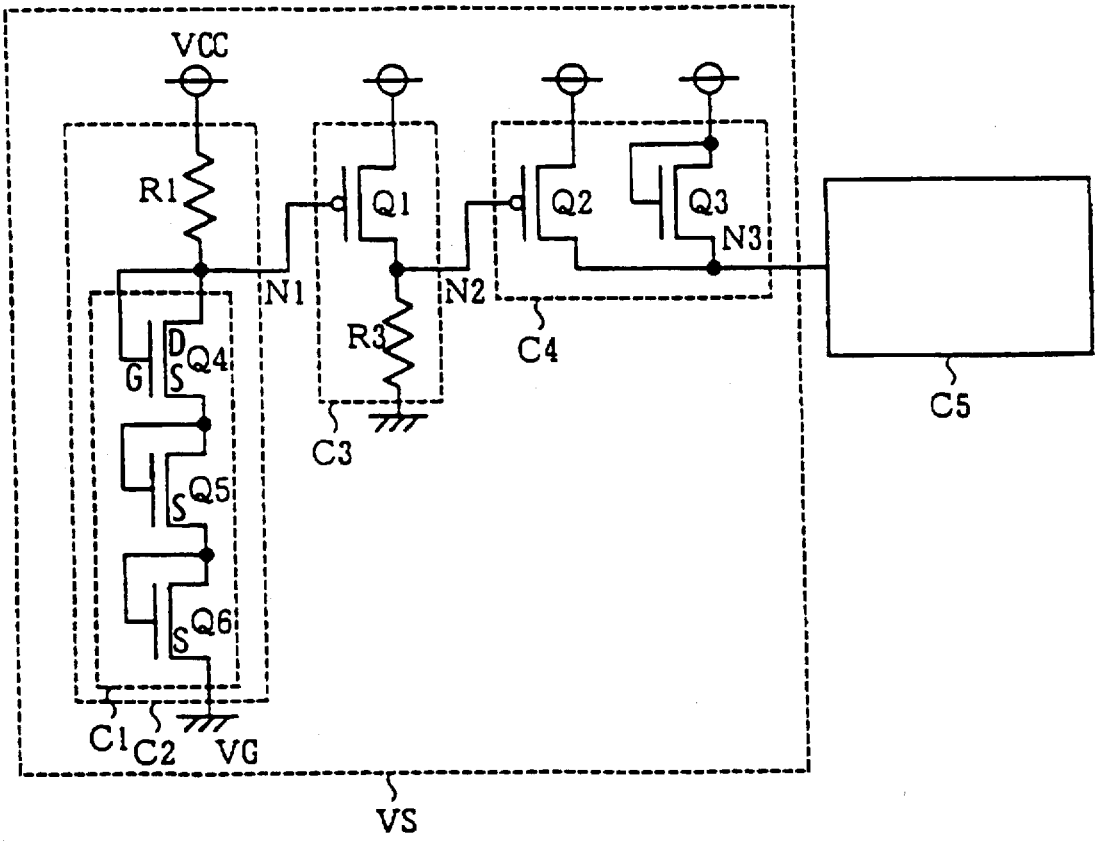
FIG. 4 is a circuit diagram showing a second embodiment for carrying out the invention.

There is shown a second embodiment of the invention in a circuit diagram of FIG. 4. In the diagram, the semiconductor potential supply device VS comprises a first power line VCC; a second power source line VG; resistors R1, R3; a constant voltage transistor circuit C1; a constant voltage circuit means C2; an input circuit means C3, an output circuit means C4; an internal circuit C5 as a semiconductor memory circuit; a P-channel type MOS transistor Q1 as a first transistor circuit; a P-channel type MOS transistor Q2 as a second transistor circuit; an N-channel type MOS transistor Q3 as a third transistor circuit; a first node N1, a second node N2; and a third node N3. In each transistor, S, D and G denote respectively a source, drain, and gate. They are identical or similar to those of the first embodiment shown in FIG. 1.

In this second embodiment, however, there is a difference in construction of the constant voltage transistor circuit C1 for establishing the potential of the node N1. That is, the constant voltage transistor circuit C1 is comprised of a series connection of N-channel type MOS transistors Q4, Q5, and Q6. In each of the transistors Q4, Q5, Q6, the drain D and gate G are connected together. In this construction, the transistors Q4 and Q5 are in a back gate state, but the transistor Q6 is not in that state.

In this case, suppose that the threshold voltage of the N-channel MOS transistor without the back gate effect is Vtn, and the threshold voltage of N-channel MOS transistor with the back gate effect is Vtn'. Then, the potential at node N1 for determining the prescribed voltage value is 2 Vtn'+Vtn. The threshold voltage Vtn of the N-channel MOS transistor is about 0.7 V with back gate effect, while the threshold voltage Vtn' is about 1.4 V without back gate effect. Therefore an advantage is achieved that it becomes possible to adjust the setting of potential of the node N1 in a small margin by inserting the N-channel MOS transistor without back gate effect in series.

In addition, although the constant voltage transistor circuit C1 is comprised of three transistors in FIG. 2, the number of the transistors may be properly adjusted depending on the required potential.

Usually, in a static random access memory SRAM serving as a semiconductor memory device, a N-channel MOS transistor is employed in the memory cell, and a threshold voltage of the N-channel type transistor is strictly controlled. Therefore, the threshold voltage of the N-channel type transistor is one of the parameters with smallest fluctuations or variations among other parameters in a wafer process.

That is, the voltage 2 Vth'+Vtn for specifying the node N1 is very small in fluctuation and variation, and there is an advantage of minimizing fluctuation.

Third Embodiment

Figure 5:
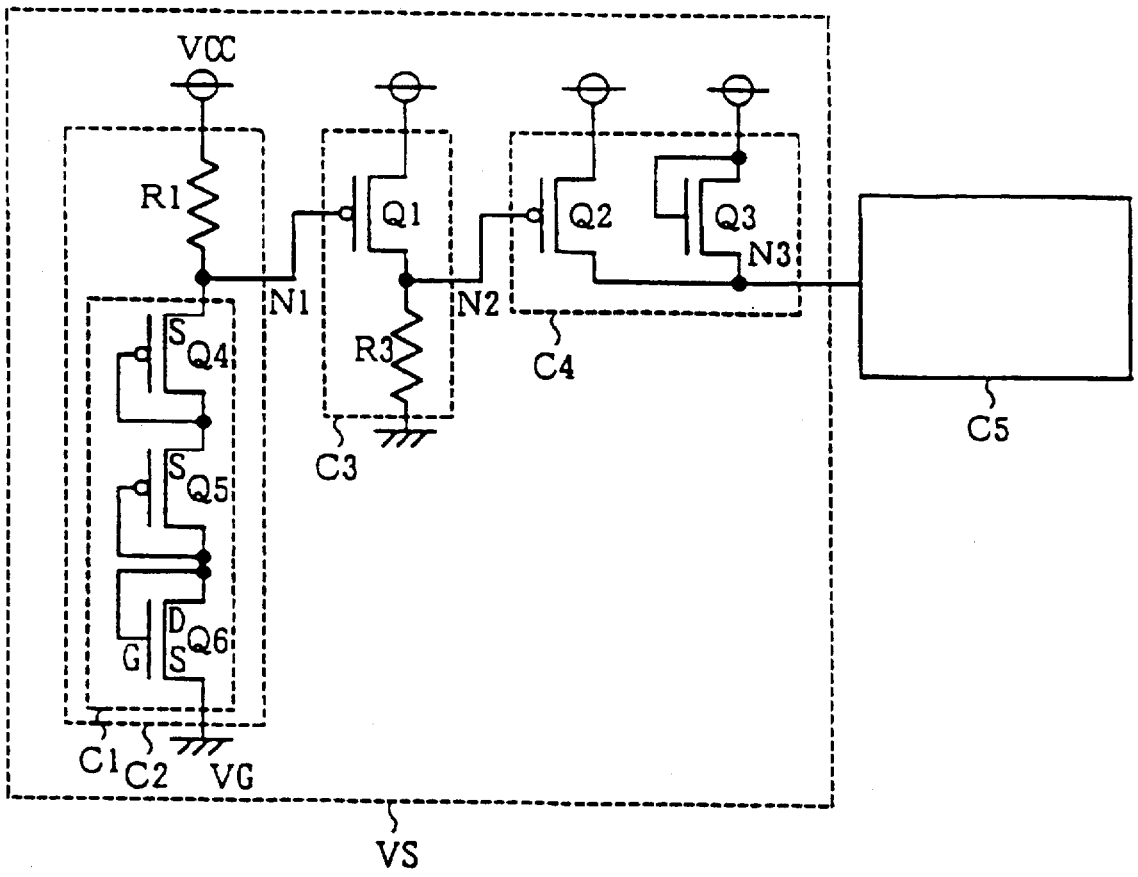
FIG. 5 is a circuit diagram showing a third embodiment for carrying out the invention.

There is shown a third embodiment of the invention in a circuit diagram of FIG. 5. In the diagram, the semiconductor potential supply device VS comprises a first power source line VCC; a second power source line VG; resistors R1, R3; a constant voltage transistor circuit C1; a constant voltage circuit means C2; an input circuit means C3; an output circuit means C4; an internal circuit serving as semiconductor memory circuit C5; a P-channel type MOS transistor Q1 as a first transistor circuit; a P-channel type MOS transistor Q2 as a second transistor circuit; an N-channel type MOS transistor Q3 as a third transistor circuit; a first node N1; a second node N2; and a third node N3. In each transistor, S, D and G indicate respectively a source, drain, and gate. They are identical or similar to those of the first embodiment shown in FIG. 1.

In this third embodiment, however, there is a difference in construction of the constant voltage transistor circuit C1 for establishing the potential of the node N1. That is, the constant voltage transistor circuit C1 is comprised of P-channel type MOS transistors Q4, Q5, and N-channel MOS transistor Q6 connected in series. In each one of the transistors Q4, Q5, Q6, the drain D and gate G are connected together. In this construction, the transistors Q4 and Q5 have back gate effect, but the transistor Q6 is free from back gate effect.

In the first embodiment shown in FIG. 1, the action point was about 3.5 V. This means that the potential supplied to the internal circuit C2 dose not become higher than 3.5 V as far as the external voltage VCC is 5 V or less. Hence, reliability of the internal circuit C5 is assured, but on the other hand it becomes vulnerable to software errors. This is because the supply potential of a memory cell in the internal circuit C5 is stepped down, and the electric charge held in the memory node of the cell is decreased as compared with the case of not stepping down the supply potential of the memory cell. When the step-down circuit VS in the first embodiment is applied for the static random access memory SRAM capable of assuring the reliability of the internal circuit C5 up to 4.5 V, the voltage is stepped down to 3.5 V for the circuit to which a voltage of up to 4.5 V is applicable. Then it becomes vulnerable to software errors. To solve this problem, the prescribed voltage value VSP=VN1+Vtp may be raised to 4.5 V for resistance to software errors and assurance of reliability.

In the first embodiment, for the purpose of raising the prescribed voltage value for activity, the easiest way is to increase the number of the P-channel MOS transistors connected to the high resistor R1. However, when connecting simply three P-channel MOS transistors in series, the value VSP becomes VSP=VN1+Vtp=3 Vtp'+Vtp=4.9 V, and a voltage exceeding a limit voltage capable of assuring the reliability of 4.5 V is applied to the internal circuit. This means jumping over the limit immediately at once.

In the third embodiment shown in FIG. 3, a N-channel MOS transistors Q6 without back gate effect is added, not any P-channel MOS transistor with back gate effect. In the N-channel MOS transistor Q6 of the third embodiment, the transistor Q6 does not have a back gate effect since the source electrode S is connected to ground potential VG, and therefore the threshold voltage Vth is relatively small, being about 0.7 V. The threshold value Vtp' of the P-channel MOS transistor with back gate effect is usually about 1.4 V, the threshold voltage without back gate effect Vtp is of 0.7 V, and hence the value VSP of the third embodiment is VSP=VN1+Vtp=2 Vtp'+Vtn+Vtp=about 4.2 V. Therefore, if the reliability of the static random access memory (SRAM) of the internal circuit C5 may be assured up to 4.5 V, it is just an appropriate potential, and the resistivity to software errors may be enhanced without sacrificing the reliability of the internal circuit C5.

Although the two P-channel MOS transistors and one N-channel MOS transistor are connected in series in the constant voltage transistor circuit C1 in FIG. 5, it is a matter of course that the combination of numbers may be properly selected depending on the potential of any desired action point.

Fourth Embodiment

Figure 6:
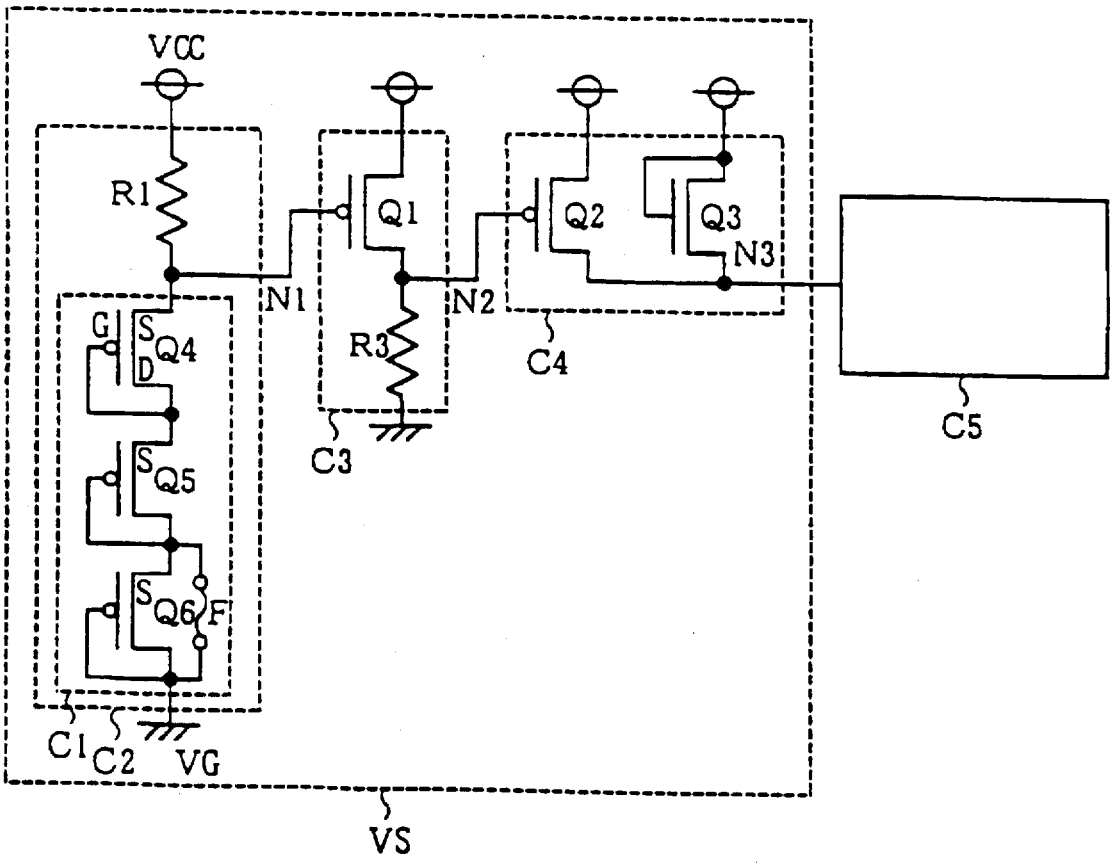
FIG. 6 is a circuit diagram showing a fourth embodiment for carrying out the invention.
Figure 7:
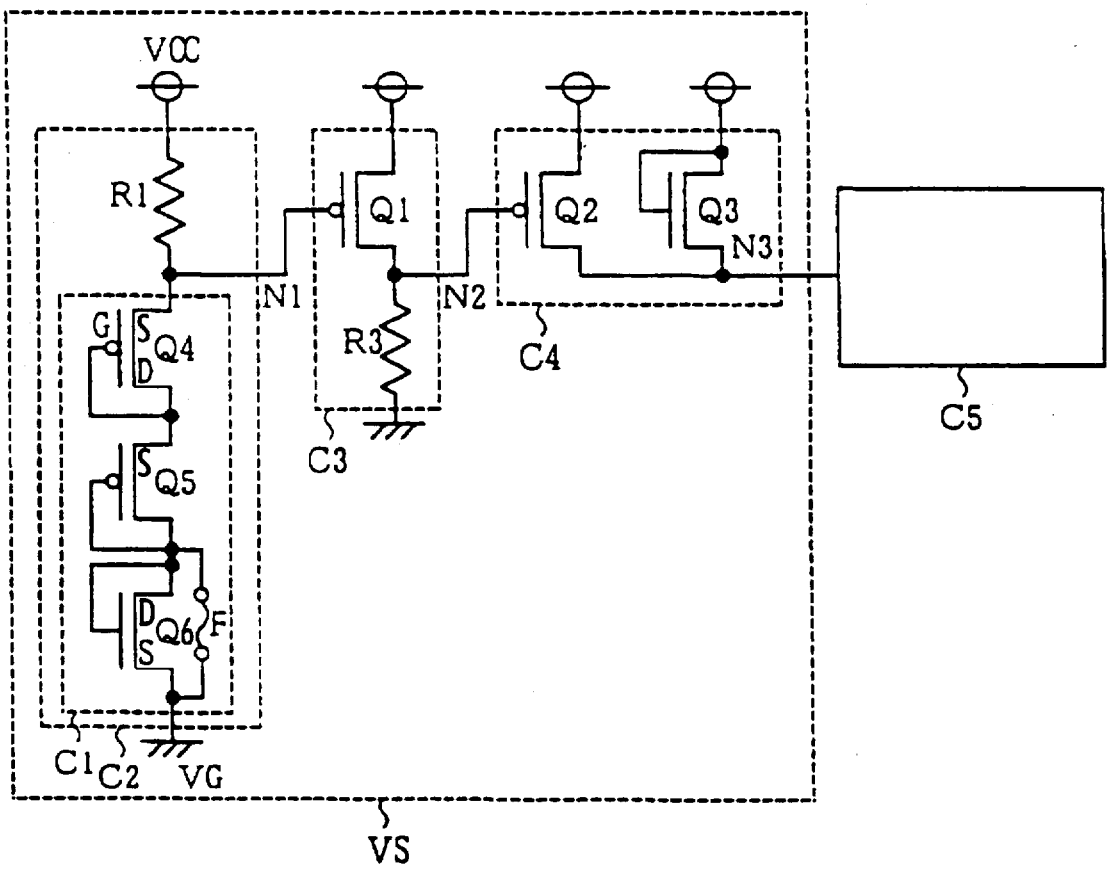
FIG. 7 is a circuit diagram showing a fifth embodiment for carrying out the invention.

There is shown a fourth embodiment of the invention in a circuit diagram of FIG. 6. In the diagram, the semiconductor potential supply device VS comprises a first power source line VCC; a second power source line VG; resistors R1, R3; a constant voltage transistor is circuit C1; a constant voltage circuit means C2; an input circuit means C3; an output circuit means C4; an internal circuit C5 as semiconductor memory circuit unit; a P-channel type MOS transistor Q1 as a first transistor circuit; a P-channel type MOS transistor Q2 as a second transistor circuit; an N-channel type MOS transistor Q3 as a third transistor circuit; a first node N1; a second node N2; and a third node N3. In each transistor, S, D and G indicate respectively a source, drain, and gate.

They are identical or similar to those of the first embodiment shown in FIG. 1.

In this fourth embodiment, however, there is a difference in construction of the constant voltage transistor circuit C1 for establishing the potential of the first node N1. That is, the constant voltage 30 transistor circuit C1 is comprised of P-channel type MOS transistors Q4, Q5, and Q6 connected in series, and further a fuse F is connected in parallel to the MOS transistor Q6. In each one of the transistors Q4, Q5, Q6, the drain D and gate G are connected together.

Thus, in the fourth embodiment, at least one transistor is preliminarily short-circuited by a fuse among a plurality of transistors of the constant voltage transistor circuit C1 connected to the high resistor R1 for establishing the action point value VSP.

In this manner, when the MOS transistor Q6 is short-circuited by a fuse, the potential of the node N1 is determined by the threshold voltages of two MOS transistors Q4, Q5. But when the fuse F is cut off, the potential of the node N1 is determined by the threshold voltages of three MOS transistors Q4, Q5, Q6. As a result, the value VSP of the "action point" may be adjusted by cutting off the fuse.

For example, in the first embodiment in FIG. 1, suppose the "action point" value is about 3.5 V. If a product having a step-down circuit VS as shown in FIG. 1 is manufactured sometime later by a different process, then the reliability of the transistor may be improved owing to progress in process technology, and a voltage up to 5 V may be applied. Even in that case, the step-down circuit in FIG. 1 still steps down voltage to 3.5 V. This means that the advanced process technology cannot be effectively utilized, and the lowered voltage is supplied to the internal circuit C5, resulting in vulnerability to software errors. To cope with this situation, as arranged in this the fourth embodiment, one of a plurality of transistors may be short-circuited by a fuse, and the fuse may be cut off depending on the progress in process technology. Then maximum resistance to software errors may be achieved while maintaining the reliability of the internal circuit C5.

In this case, the fuse F may be formed of a polysilicon film or a metal wiring for example. The fuse F may be cut off by irradiating a laser beam for example.

Fifth Embodiment

There is shown a fifth embodiment of the invention in a circuit diagram of FIG. In the diagram, the semiconductor potential supply device VS comprises a first power source line VCC; a second power source line VG; resistors R1, R3; a constant voltage transistor circuit C1; a constant voltage circuit means C2; an input circuit means C3; an output circuit means C4; an internal circuit C5 as a semiconductor memory circuit; a P-channel type MOS transistor Q1 as a first transistor circuit; a P-channel type MOS transistor Q2 as a second transistor circuit; an N-channel type MOS transistor Q3 as a third transistor circuit; a first node N1; a second node N2; and a third node N3. In each transistor, S, D and G indicate respectively a source, drain, and gate. They are identical or similar to those of the first embodiment shown in FIG. 1.

In this fifth embodiment, however, there is a difference in the construction of the constant voltage transistor circuit C1 for establishing the potential of the first node N1. That is, the constant voltage transistor circuit C1 is comprised of P-channel type MOS transistors Q4, Q5, and an N-channel type MOS transistor Q6 connected in series, and further a fuse F is connected in parallel to the MOS transistor Q6. In each one of the transistors Q4, Q5, Q6, the drain D and gate G are connected together.

Thus, in the fifth embodiment, a combination of P-channel type and N-channel type transistors is employed for a plurality of series MOS transistors in the constant voltage transistor circuit C1 connected to resistor R1 for specifying VSP, and the N-channel type MOS transistor Q6 free from back gate effect is short-circuited by fuse F.

In this manner, the MOS transistor Q6 is short-circuited by the fuse F, so that the potential of the node N1 is determined by the threshold voltages of two P-channel type MOS transistors Q4, Q5. But when the fuse F is cut off, the potential of the node N1 is determined by the threshold values of two P-channel type MOS transistors Q4, Q5 with back gate effect, and one N-channel type MOS transistor Q6 without back gate effect. The threshold voltage Vtn of the N-channel type MOS transistor Q6 without back gate effect is normally small and is about 0.7 V. Therefore the adjustment steps of the value VSP is adjustable more exactly and finely.

Also in this case, the number of MOS transistors assembled in the constant voltage transistor circuit C1 may be properly selected depending on the desired potential at the action point, on condition that at least one of MOS transistors free from back gate effect is short-circuited.

Sixth Embodiment

Figure 8:
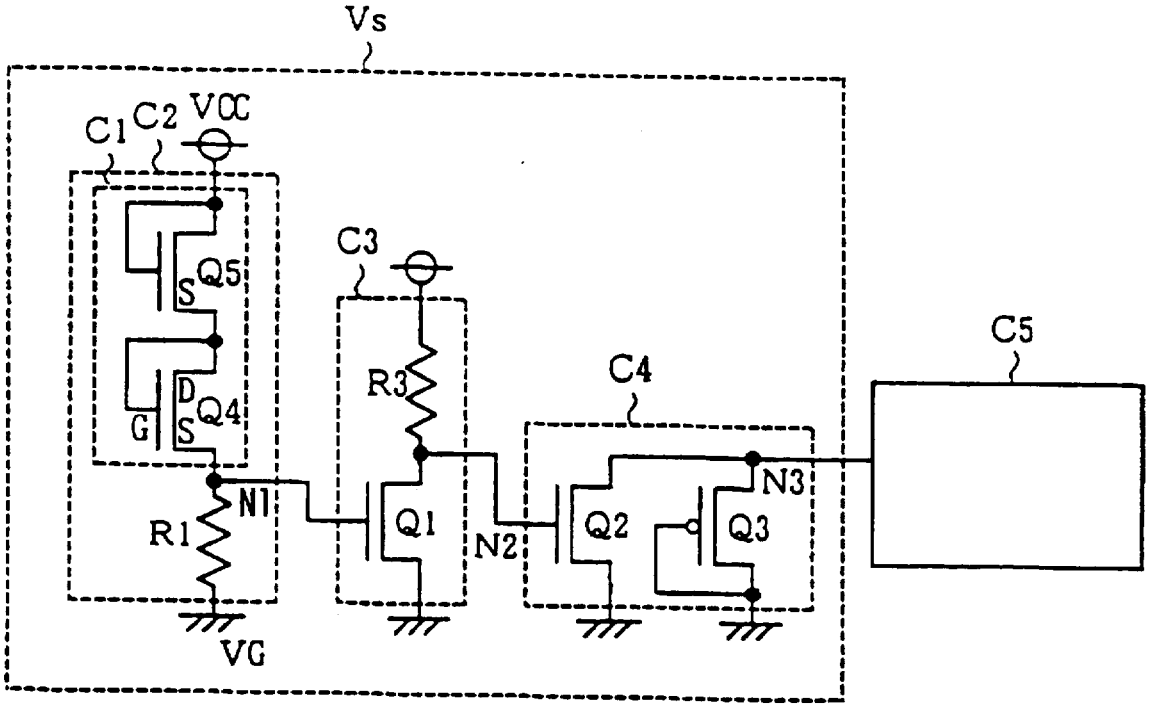
FIG. 8 is a circuit diagram showing a sixth embodiment for carrying out the invention.

FIG. 8 is a circuit diagram showing a sixth embodiment of the invention for a semiconductor potential supply device and a semiconductor memory apparatus using the same. In the diagram, the semiconductor potential supply device VS (hereinafter called a boosting circuit) comprises a first power source line VG; a second power source line VCC; resistors R1, R3; a constant voltage transistor circuit C1; a constant voltage circuit means C2; an input circuit means C3; an output circuit means C4; a semiconductor memory circuit C5 (hereinafter called an internal circuit); an N-channel type MOS transistor Q1 as a first transistor circuit; an N-channel type MOS transistor Q2 as a second transistor circuit; a P-channel type MOS transistor Q3 as a third transistor circuit; N-channel type MOS transistors Q4, Q5; a first node N1; a second node N2; and a third node N3. In each transistor, S, D and G indicate respectively a source, drain, and gate.

In the constant voltage circuit means C2 shown in this sixth embodiment, resistor R1 and the constant voltage transistor circuit C1 are connected in series at the first node N1. The resistor R1 is connected to ground potential line VG serving as a first power line and the constant voltage transistor circuit C1 is connected to the supply potential line VCC serving as a second power source line. This constant voltage transistor circuit C1 is comprised of a plurality of N-channel MOS transistors Q4, Q5 connected in series with each gate and drain connected together.

In the input circuit means C3, the N-channel type first MOS transistor Q1 is connected to the ground potential line VG, and a potential from the first node N1 is supplied to its gate G. The transistor Q1 and the resistor R3 connected to the supply potential line VCC are connected in series at the second node N2.

The output circuit means C4 is comprised of a second N-channel type MOS transistor Q2 connected between the ground potential line VG and the third node N3 for supplying the potential VSS to the internal circuit C5, and a potential from the second node N2 is supplied to its gate G. A third MOS transistor Q3 of P-channel type is connected in parallel to the second MOS transistor Q2. The gate and drain of the third P-channel type MOS transistor Q3 are connected together.

Figure 9:
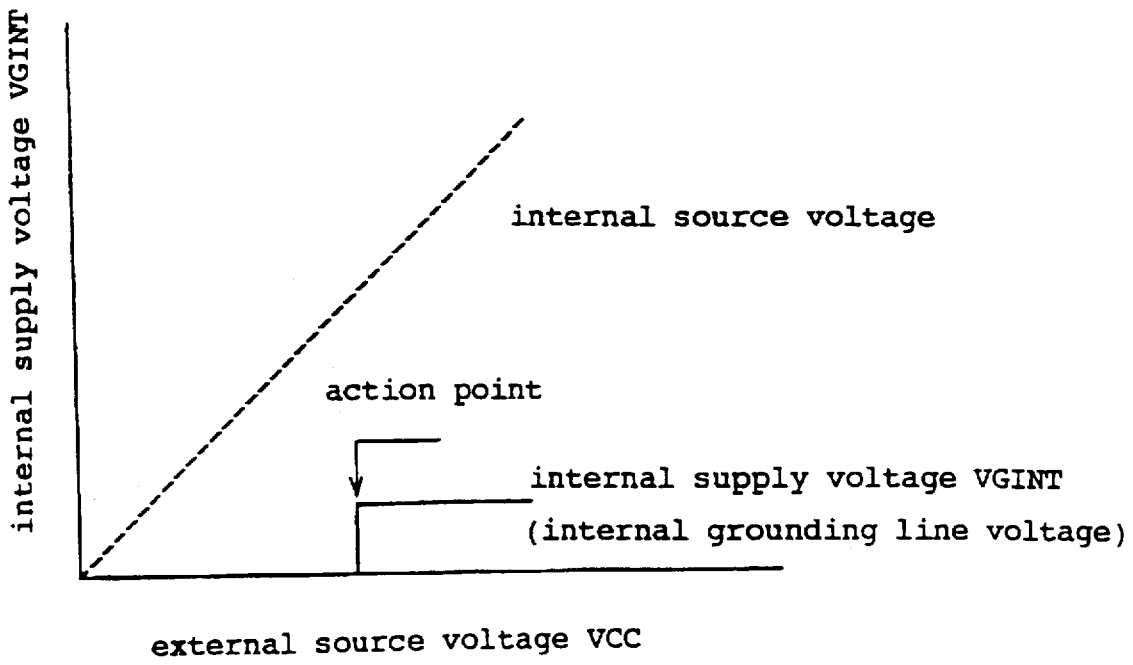
FIG. 9 is a diagram for explaining the operation of the sixth embodiment for carrying out the invention.

The sixth embodiment in FIG. 8 shows a boosting circuit of the first power line, i.e., ground potential line VG, which is in contrast a counterpart of the step-down circuit of the supply potential line VCC in FIG. 1. In principle, the step-down circuit VS shown in embodiments 1 to 5 are intended to lower the voltage applied to the transistors in the internal circuit C5 in order to assure the reliability, and therefore in contrast, the reliability of the transistor may be also assured by boosting the internal supply potential VGINT supplied to the internal circuit C5 from the ground potential VG as shown in the sixth embodiment. FIG. 9 shows this situation.

In FIG. 9, suppose that the external voltage is VCC, the potential at node N1 is VN1, and the threshold voltage of N-channel MOS transistor Q1 without back gate effect is Vtn. Then when the following relation is established, $$VCC-VN1=Vtn,$$

the N-channel MOS transistor Q1 is turned on, and the boosting of the ground potential and the direct coupling with the grounding potential are changed over. Establishing the VCC at this time to be the action point VSP, the following relations are obtained.

$$VSP-VN1=Vtn$$

$$VSP=VN1+Vtn$$

In this sixth embodiment, even if the value of resistor R1 fluctuates, the node N1 is determined by the sum of the threshold voltages of transistors Q4 and Q5. That is, supposing Vtn' to be the threshold of P-channel MOS transistor with back gate effect, the action point is reached when the external supply voltage VCC becomes 2 Vtn'+Vtn.

Therefore, when the external supply voltage VCC is 2 Vtn' or less, Q4 and Q5 are off, and the node N1 is charged by the resistor R1 to the ground potential VG. As a result, the N-channel MOS transistor Q1 is turned off, whereby the node N2 is boosted nearly to the supply voltage VCC by the resistor R3. Hence, the N-channel MOS transistor Q2 is turned on, and the internal supply potential VGINT in the node N3 for supplying the ground potential of the internal circuit C5 becomes equal to the ground potential VG.

On the other hand, when the external supply voltage VCC is larger than 2 Vtn', the N-channel MOS transistors Q4 and Q5 are turned on, and the node N1 attains VCC−2 Vtn'. Consequently, when the external supply voltage VCC exceeds 2 Vtn'+Vtn, the N-channel MOS transistor Q1 is turned on to lower the node N2, and the N-channel MOS transistor Q2 is turned off. As a result, the internal supply potential VGINT applied to the internal circuit CS is supplied only through the P-channel MOS transistor Q3, and the potential boosted by the portion of the threshold voltage Vtp of the P-channel MOS transistor Q3 is supplied as the ground potential to the internal circuit C5.

In this sixth embodiment, since the prescribed value (action point) is always specified by 2 Vtn'+Vtn, the value does not change significantly even if the resistor value R1 fluctuates. Usually Vtn=0.7 V, Vtn'=1.4 V approximately, are therefore the action point value is around 3.5 V. That is, in normal operation with external power source of 5 V, the ground potential to be supplied to the internal circuit C5 is boosted by the boosting circuit VS. And in the state of data holding only, the ground potential VG is not boosted, and the data of the memory cells in the internal circuit C5 is protected.

In the conventional device, it takes a very long time until the potential of the node N1 rises up to a required point, when the external voltage VCC rises suddenly, for example from data holding mode 3 V to ordinary mode 5 V. On the other hand, in the sixth embodiment, the internal voltage may be changed over following the changes of the external power source by boosting the potential of the node N1 immediately after turning on of the N-channel MOS transistors Q4 and Q5.

Seventh Embodiment

Figure 10:
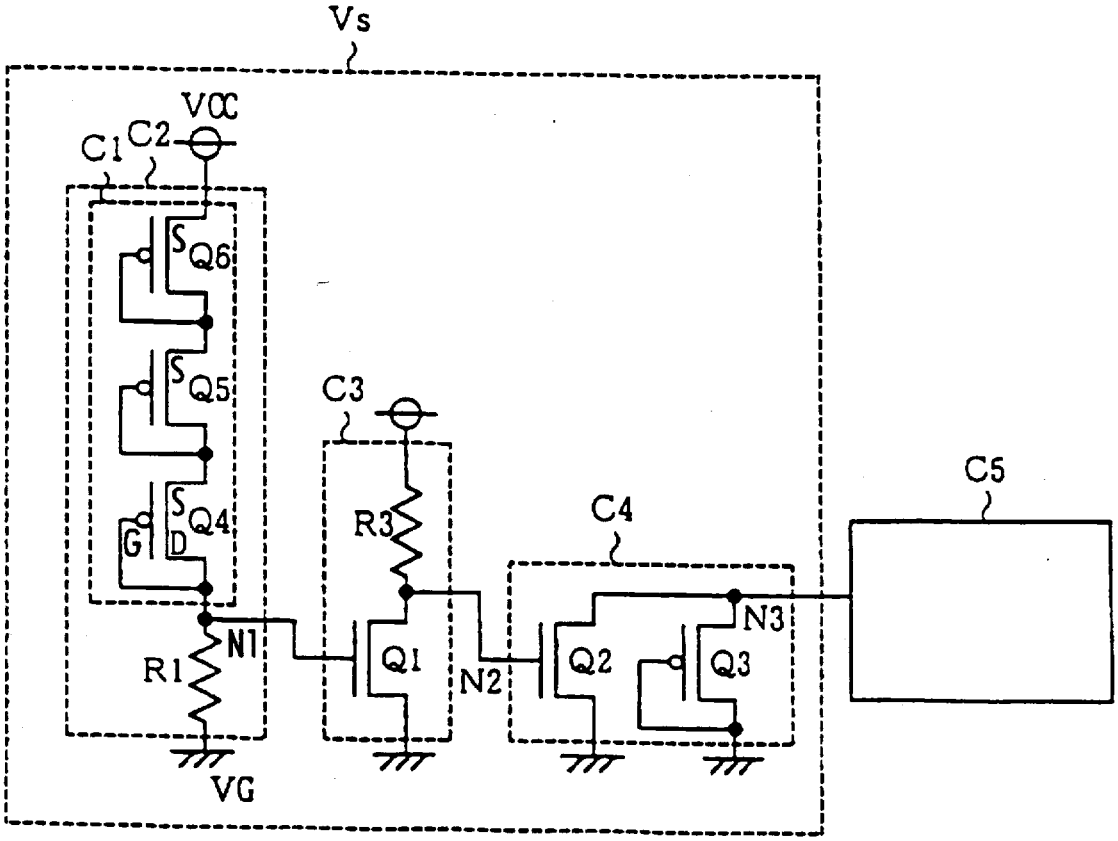
FIG. 10 is a circuit diagram showing a seventh embodiment for carrying out the invention.

FIG. 10 is a circuit diagram showing a seventh embodiment of the invention. In this seventh embodiment, there is a difference in construction of the constant voltage transistor circuit C1 for specifying the potential of the node N1. That is, the constant voltage transistor circuit C1 is comprised of a series connection of P-channel type MOS transistors Q4, Q5, Q6. In each one of the transistors Q4, Q5, Q6, the drain D and gate G are connected together. In this construction, the transistors Q4 and Q5 have back gate effects, but the transistor Q6 is free from back gate effect. The other construction is same as in the sixth embodiment shown in FIG. 8, and the same reference numerals indicate same or similar elements, and therefore a further description thereof is omitted herein.

In this case, suppose the threshold voltage of the P-channel MOS transistor without back gate effect is Vtp, and the threshold voltage of N-channel MOS transistor with back gate effect is Vtp', then the potential at the node N1 for specifying the action point is 2 Vtp'+Vtp. The threshold voltage Vtp of the N-channel MOS transistor is about 0.7 V with back gate effect, while the threshold voltage Vtp' is about 1.4 V without back gate effect. Thus, by inserting the P-channel MOS transistor without back gate effect in series, there is an advantage for adjusting the setting of potential of the node N1 in a small margin.

In FIG. 10, the constant voltage transistor circuit C1 is comprised of three transistors, but the number of transistors may be properly adjusted depending on the required potential.

Eighth Embodiment

Figure 11:
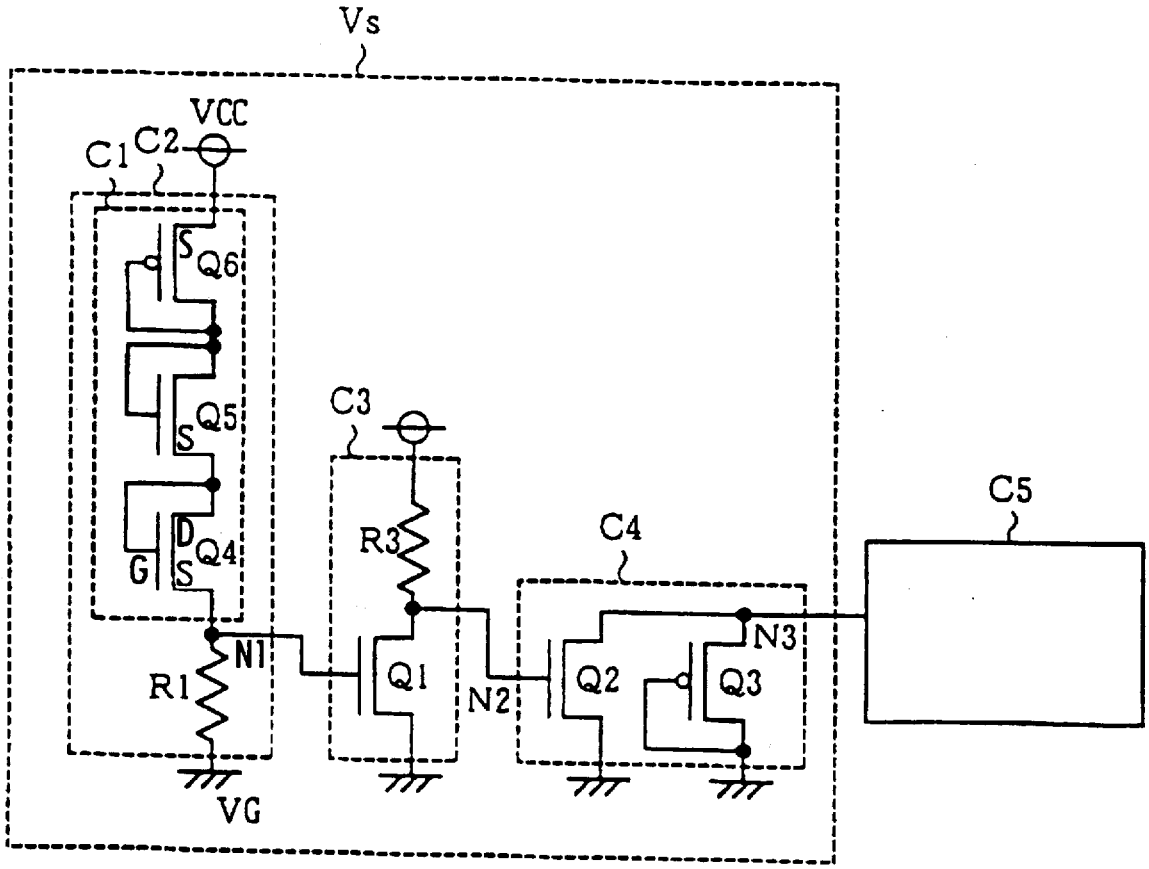
FIG. 11 is a circuit diagram showing a eighth embodiment for carrying out the invention.

FIG. 11 is a circuit diagram showing an eighth embodiment of the invention. In this eighth embodiment, there is a difference in construction of the constant voltage transistor circuit C1 for specifying the potential of the node N1. That is, the constant voltage transistor circuit C1 is comprised of N-channel type MOS transistors Q4, Q5, and a P-channel type MOS transistor Q6 connected in series. In each one of the transistors Q4, Q5, Q6, the drain D and gate G are connected together. In this construction, the transistors Q4 and Q5 have back gate effects, but the transistor Q6 is free from back gate effect. The other construction is same as in the sixth embodiment shown in FIG. 8, and the same reference numerals indicate same or similar elements, and therefore a further description thereof is omitted herein.

In the sixth embodiment shown in FIG. 8, the action point value was about 3.5 V. Suppose the boosting circuit VS of the sixth embodiment in FIG. 8 is used in the static random access memory (SRAM) in which the reliability of the internal circuit C5 is guaranteed up to 4.5 V, then the supply voltage is still stepped down ineffectively to 3.5 V for the circuit to which a voltage of up to 4.5 V may be applied, resulting in unnecessary vulnerability to software errors.

To raise the prescribed action point value VSP in the sixth embodiment, it is an easy way to increase the number of N-channel MOS transistors connected to the high resistor R1. However, if three transistors are simply connected in series, the action point value VSP becomes about 4.9 V and exceeds the limit voltage of 4.5 V for securing reliability. Accordingly, in the eighth embodiment shown in FIG. 11, a P-channel MOS transistor Q6 is added without back gate effect, not a N-channel MOS transistor with back gate effect.

The P-channel MOS transistor Q6 in the eighth embodiment is free from back gate effect because the source electrode S is connected to the supply potential VCC, and therefore the threshold voltage Vtp is relatively small, being about 0.7 V. As a result, the action point Vsp in this case is about 4.2 V.

Thus, when the reliability of the static random access memory (SRAM) of the internal circuit C5 may be assured up to 4.5 V, it is just an appropriate potential, and resistance to software errors may be improved without sacrificing the reliability of the internal circuit.

In the constant voltage transistor circuit C1 in FIG. 11, two N-channel MOS transistors and one P-channel MOS transistor are connected in series, but the combination of numbers of transistors may be properly selected depending on the potential of the desired action point.

Ninth Embodiment

Figure 12:
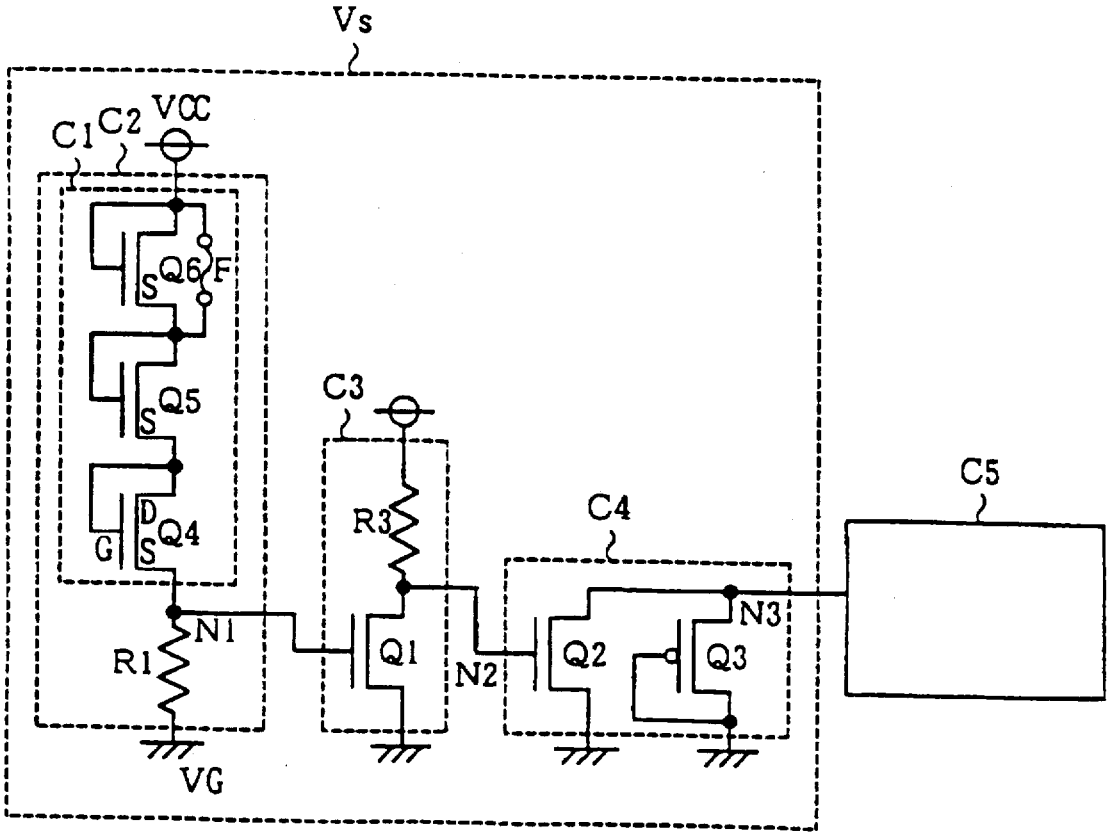
FIG. 12 is a circuit diagram showing a ninth embodiment for carrying out the invention.

FIG. 12 is a circuit diagram showing a ninth embodiment of the invention. In this ninth embodiment, there is a difference in construction of the constant voltage transistor circuit C1 for specifying the potential of the node N1. That is, the constant voltage transistor circuit C1 is comprised of N-channel type MOS transistors Q4, Q5, and Q6 connected in series, and a fuse F is connected in parallel to the MOS transistor Q6. In each one of the transistors Q4, Q5, Q6, the drain D and gate G are connected together. The other construction is same as in the sixth embodiment shown in FIG. 8, and the same reference numerals indicate same or equivalent elements, and a further description thereof is omitted herein.

In this manner, in the ninth embodiment, it is intended to short-circuit preliminarily with a fuse at least one transistor of the constant voltage transistor circuit C1 connected to the high resistor R1 for determining the action point value VSP.

In the above arrangement, the MOS transistor Q6 is short-circuited by a fuse, so that the potential of the node N1 is determined by the threshold voltages of two MOS transistors Q4, Q5. But when the fuse F is cut off, the potential of the node N1 is determined by the threshold voltages of the three MOS transistors Q4, Q5, Q6. Thus, the action point value VSP may be adjusted by cutting off the fuse.

Tenth Embodiment

Figure 13:
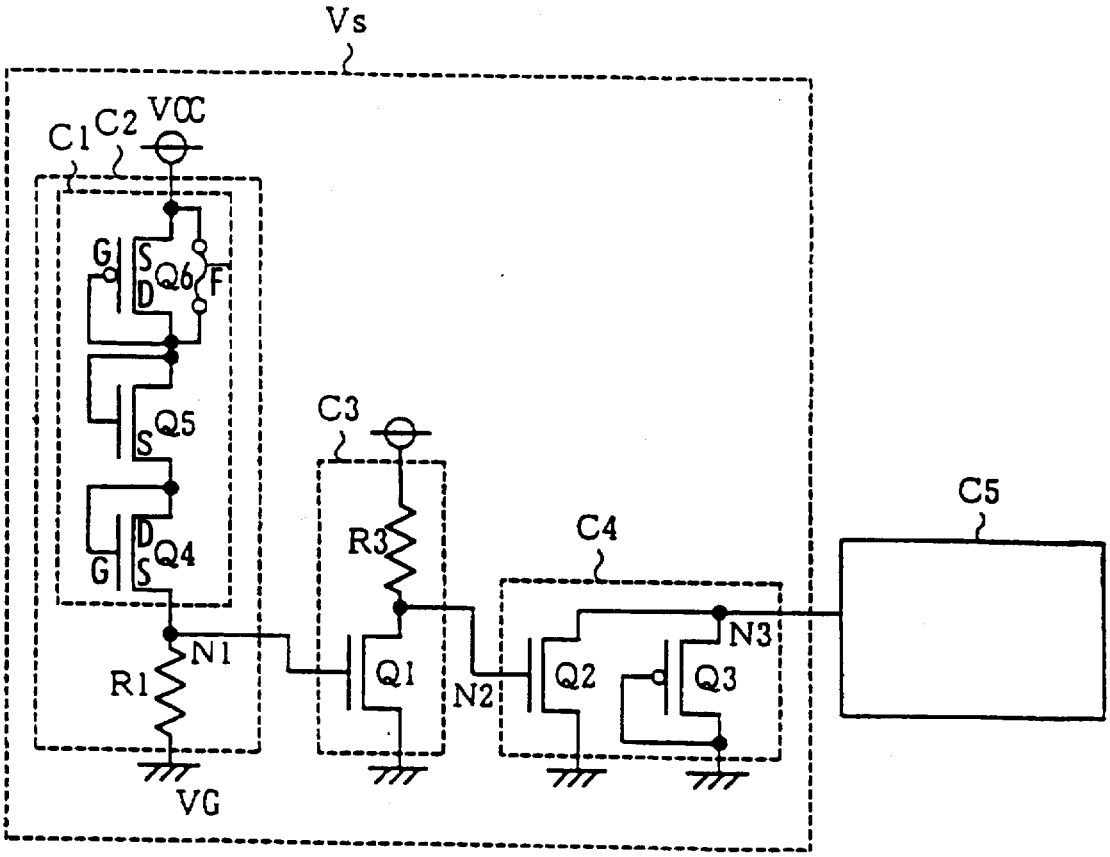
FIG. 13 is a circuit diagram showing a tenth embodiment for carrying out the invention.
Figure 14:
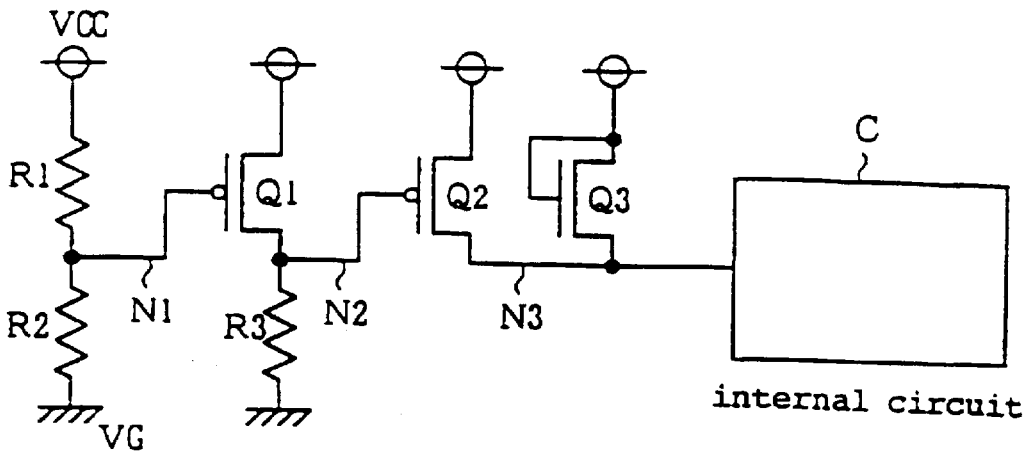
FIG.14 (PRIOR ART)
FIG. 14 is a circuit diagram showing a conventional semiconductor potential supply device.
Figure 15:
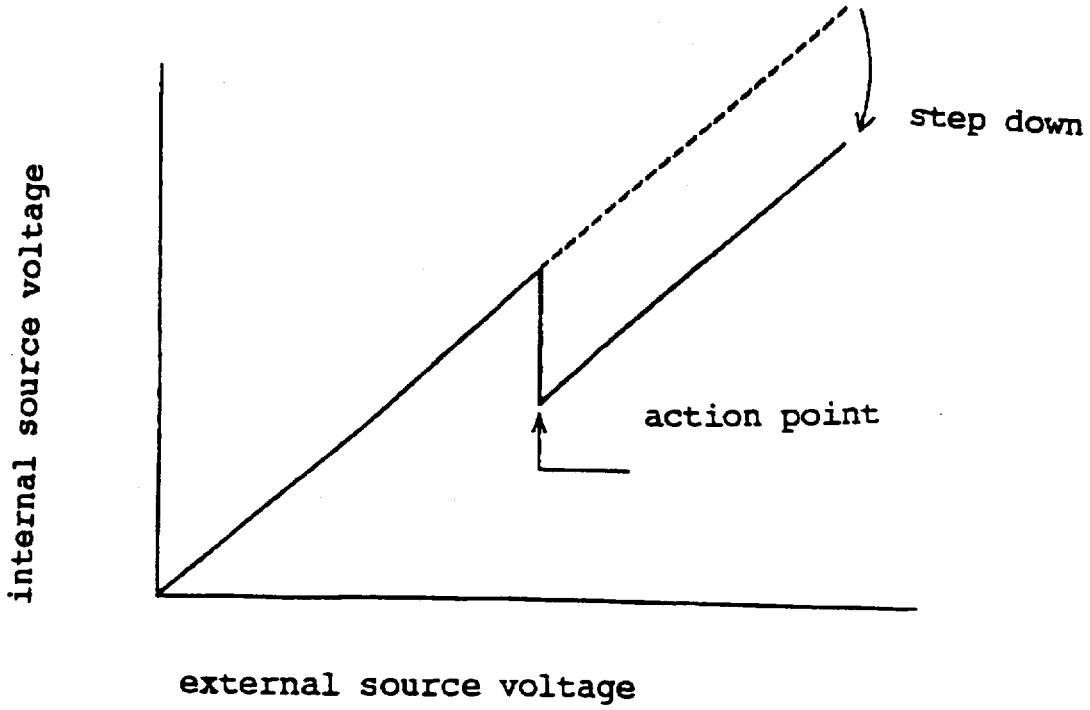
FIG.15 (PRIOR ART)
FIG. 15 is a diagram for explaining the operation of the conventional semiconductor potential supply device.
Figure 16:
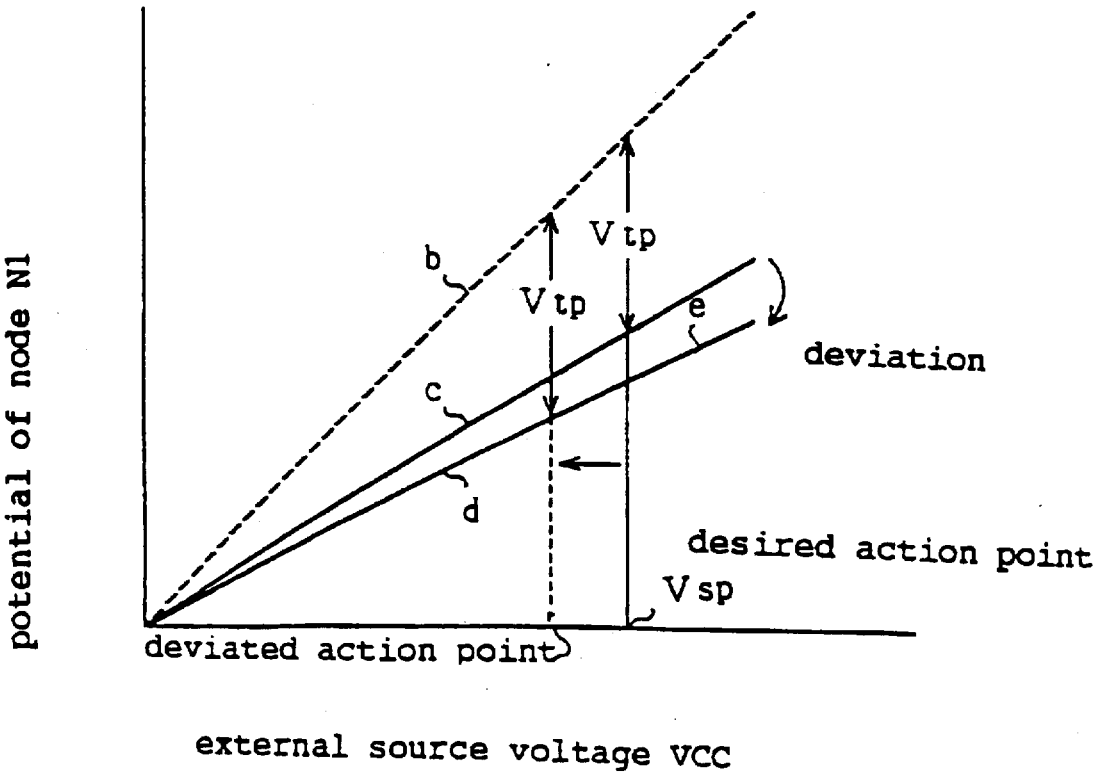
FIG.16 (PRIOR ART)
FIG. 16 is a diagram for explaining the operation of the conventional semiconductor potential supply device.

FIG. 13 is a circuit diagram showing a tenth embodiment of the invention. In this tenth embodiment, there is a difference in construction of the constant voltage transistor circuit C1 for specifying the potential of the node N1. That is, the constant voltage transistor circuit C1 is comprised of N-channel type MOS transistors Q4, Q5 and P-channel MOS transistor Q6 connected in series, and a fuse F is connected in parallel to the MOS transistor Q6. In each one of the transistors Q4, Q5, Q6, the drain D and gate G are connected together. The other construction is same as in the sixth embodiment shown in FIG. 8, and the same reference numerals indicate same or equivalent elements, and the description thereof is omitted herein.

Thus, in the tenth embodiment, a combination of P-channel type and N-channel type transistors is employed for a plurality of series MOS transistors of the constant voltage transistor circuit C1 connected to resistor R1 for specifying the action point value VSP. The P-channel type MOS transistor Q6 free from back gate effect is short-circuited by a fuse F.

In this manner, the MOS transistor Q6 is being short-circuited by the fuse F, so that the potential of the node N1 is determined by the threshold voltages of the two N-channel type MOS transistors Q4, Q5. But when the fuse F is cut off, the potential of the node N1 is determined by the threshold values of the two N-channel type MOS transistors Q4, Q5 with back gate effect and one P-channel type MOS transistor Q6 without back gate effect. The threshold voltage Vtp of the P-channel type MOS transistor Q6 without back gate effect is normally small and is about 0.7 V, and therefore the adjustment steps of the action point value VSP may be more exact and fine.

In this case also, the number of MOS transistors assembled in the constant voltage transistor circuit C1 may be properly selected depending on any desired potential at the action point. At least one of the short-circuited MOS transistors is set to be free from back gate effect.

I claim:

1. A semiconductor potential supply device comprising:

a constant voltage circuit means in which a resistor and a constant voltage transistor circuit are connected in series at a first node, said resistor being connected to a first power source line, said constant voltage transistor circuit being connected to a second power source line;

input circuit means in which a first transistor circuit and another resistor are connected in series at a second node, said first transistor circuit being connected to said first power source line, a control electrode of said first transistor circuit being supplied with a potential from said first node, said other resistor being connected to said second power source line; and output circuit means having a second transistor circuit and a third transistor circuit, said second transistor circuit being connected between said first power source line and a third node for supplying a potential, a control electrode of said second transistor circuit being supplied with a potential from said second node, said third transistor circuit being connected in parallel with said second transistor circuit, wherein said constant voltage transistor circuit includes at least two MOS transistors connected in series with an electrode of one of said at least two MOS transistors connected to said first node and an electrode of another one of said at least two MOS transistors connected to said second power source line, and each of said at least two transistors has its gate and drain connected together.

2. The semiconductor potential supply device in accordance with claim 1, wherein at least one of said at least two MOS transistors is free from a back gate effect.

3. The semiconductor potential supply device in accordance with claim 2, wherein said at least one of the at least two MOS transistors free from back gate effect is short-circuited by a fuse in said constant voltage transistor circuit.

4. The semiconductor potential supply device in accordance with claim 1, wherein said at least two MOS transistors include at least one P-channel MOS transistor and at least one N-channel MOS transistor.

5. The semiconductor potential supply device in accordance with claim 4, wherein at least one of said at least two MOS transistors is free from a back gate effect.

6. The semiconductor potential supply device in accordance with claim 1, wherein at least one of the at least two MOS transistors is short-circuited by a fuse.

7. The semiconductor potential supply device in accordance with claim 1, wherein said third transistor circuit includes a MOS transistor having its gate and drain connected together.

8. The semiconductor potential supply device in accordance with claim 1, wherein said first power source line is a power source line and second power source line is a ground line.

9. The semiconductor potential supply device in accordance with claim 8, wherein said at least two MOS transistors include at least one P-channel MOS transistor and at least one N-channel MOS transistor.

10. The semiconductor potential supply device in accordance with claim 8, wherein said third transistor circuit includes a MOS transistor having its gate and drain connected together.

11. The semiconductor potential supply device in accordance with claim 1, wherein said first power source line is a ground line and said second power source line is a power source line.

12. The semiconductor potential supply device in accordance with claim 11, wherein said at least two MOS transistors include at least one P-channel MOS transistor and at least one N-channel MOS transistor.

13. The semiconductor potential supply device in accordance with claim 9, wherein said third transistor circuit includes a MOS transistor having its gate and drain connected together.

14. A semiconductor memory apparatus comprising:

a constant voltage circuit means in which a resistor and a constant voltage transistor circuit are connected in series at a first node, said resistor being connected to a first power source line, said constant voltage transistor circuit being connected to a second power source line;

input circuit means in which a first transistor circuit and another resistor are connected in series at a second node, said first transistor circuit being connected to said first power source line, a control electrode of said first transistor circuit being supplied with a potential from said first node, said other resistor being connected to said second power source line;

output circuit means having a second transistor circuit and a third transistor circuit, said second transistor circuit being connected between said first power source line and a third node for supplying a potential, a control electrode of said second transistor circuit being supplied with a potential from said second node, said third transistor circuit being connected in parallel with said second transistor circuit; and a semiconductor memory circuit connected to said third node and supplied with a potential from said third node, wherein said constant voltage transistor circuit includes at least two MOS transistors connected in series with an electrode of one of said at least two MOS transistors connected to said first node and an electrode of another one of said at least two MOS transistors connected to said second power source line, and each of said at least two transistors has its gate and drain connected together.

* * * * *